US006581366B1

(12) United States Patent
Andrews

(10) Patent No.: US 6,581,366 B1
(45) Date of Patent: Jun. 24, 2003

(54) CUT-RESISTANT STRETCH YARN FABRIC AND APPAREL

(75) Inventor: Gregory V. Andrews, Concord, NC (US)

(73) Assignee: World Fibers, Inc., Concord, NC (US)

( * ) Notice: Subject to any disclaimer, the term of this patent is extended or adjusted under 35 U.S.C. 154(b) by 0 days.

(21) Appl. No.: 09/421,310

(22) Filed: Oct. 20, 1999

Related U.S. Application Data

(60) Provisional application No. 60/105,275, filed on Oct. 22, 1998.

(51) Int. Cl.[7] ..... D02G 3/32

(52) U.S. Cl. ..... 57/225; 57/230; 57/244

(58) Field of Search ..... 57/210, 211, 224, 57/225, 230, 231; 66/170, 171, 174

(56) References Cited

U.S. PATENT DOCUMENTS

| | | | | |
|---|---|---|---|---|
| 831,108 A | | 9/1906 | Ryder | |
| 3,490,224 A | | 1/1970 | Bourgeas | |
| 3,889,035 A | | 6/1975 | Jakes | |
| 4,004,295 A | | 1/1977 | Byrnes, Sr. | |
| 4,202,382 A | | 5/1980 | Westhead | |
| 4,384,449 A | | 5/1983 | Byrnes, Sr. et al. | |
| 4,470,251 A | * | 9/1984 | Bettcher | 2/16 |
| 4,777,789 A | | 10/1988 | Kolmes et al. | |
| 4,838,017 A | | 6/1989 | Kolmes et al. | |
| 4,912,781 A | | 4/1990 | Robins et al. | |
| 4,936,085 A | | 6/1990 | Kolmes et al. | |
| 5,070,540 A | | 12/1991 | Bettcher et al. | |
| 5,119,512 A | | 6/1992 | Dunbar et al. | |
| 5,177,948 A | | 1/1993 | Kolmes et al. | |
| 5,287,690 A | | 2/1994 | Toon | |
| 5,423,168 A | | 6/1995 | Kolmes et al. | |
| 5,442,815 A | * | 8/1995 | Cordova et al. | 2/161.7 |
| 5,568,657 A | | 10/1996 | Cordova et al. | |
| 5,597,649 A | * | 1/1997 | Sandor et al. | 428/370 |
| 5,628,172 A | | 5/1997 | Kolmes et al. | |
| 5,632,137 A | | 5/1997 | Kolmes et al. | |
| 5,655,358 A | | 8/1997 | Kolmes | |
| 5,845,476 A | | 12/1998 | Kolmes | |

FOREIGN PATENT DOCUMENTS

| | | |
|---|---|---|
| EP | 0 498 216 A1 | 8/1992 |

* cited by examiner

*Primary Examiner*—John J. Calvert
*Assistant Examiner*—Shaun Hurley
(74) *Attorney, Agent, or Firm*—Adams Evans, P.A.

(57) ABSTRACT

A cut-resistant stretch yarn having a first elastic core yarn with a first wrapper yarn spirally-wrapped around the elastic core yarn in a first twist direction. The first wrapper yarn is a highly cut-resistant yarn. A second wrapper yarn is spirally-wrapped around the elastic core yarn and the first wrapper yarn in a second twist direction. The second wrapper yarn is a highly cut-resistant yarn. The elastic core yarn may be an elastomeric yarn, neoprene or rubber.

23 Claims, 5 Drawing Sheets

CUT-RESISTANT STRETCH YARN FABRIC AND APPAREL

TECHNICAL FIELD AND BACKGROUND OF THE INVENTION

This application claims priority based upon Provisional Patent Application No. 60/105,275, filed on Oct. 22, 1998.

This invention relates to a cut-resistant stretch yarn, and fabrics and apparel made from such stretch yarns. The invention has particular application in the fabrication of protective fabrics and protective apparel, such as gloves, jackets and apparel liners. Such items may be fabricated from knitted or woven yarns, and the provision of elasticity in the yarn permits the items to be made more form-fitting and thus more comfortable. In addition, such items may be fabricated from woven fabrics formed from the yarns, and thus used in some applications rather than knitted fabrics, which inherently have a degree of stretch and conformability without regard to the yarns from which they are knitted.

Many prior art cut-resistant yarn constructions and fabrics have been proposed and are used in many occupations where sharp objects must be manually handled. Thus, meat cutters, glass and metal handlers and medical personnel often are required by employers to wear protective gloves or other garments fabricated from cut-resistant yarns.

Many such yarns have steel or other cut-resistant metal wire cores surrounded by wrappers of one or more synthetic filament yarns which are principally intended to render the yarn, comfortable enough to be practical in garment form. The steel core wire provides the vast majority of the cut-resistance to the yarn. Obviously, such yarns cannot be made elastic, since steel and all other cut-resistant metals are inherently inelastic. There is thus a need for a yarn which is both highly elastic and also has a high degree of cut-resistance.

SUMMARY OF THE INVENTION

Therefore, it is an object of the invention to provide a cut-resistant yarn which is highly elastic.

It is another object of the invention to provide a cut-resistant yarn which is highly flexible and capable of being formed into many woven and knitted fabric constructions.

It is another object of the invention to provide a cut-resistant yarn which can be fabricated from a variety of elastic core materials.

It is another object of the invention to provide a cut-resistant garment which has enhanced dexterity, and will conform to the body part, such as the hand, without slipping.

These and other objects of the present invention are achieved in the preferred embodiments disclosed below by providing a cut-resistant stretch yarn, comprising a first elastic core yarn, a first wrapper yarn spirally-wrapped around the elastic core yarn in a first twist direction, the first wrapper yarn comprising a highly cut-resistant yarn, and a second wrapper yarn spirally-wrapped around the elastic core yarn and the first wrapper yarn in a second twist direction, the second wrapper yarn comprising a highly cut-resistant yarn.

According to one preferred embodiment of the invention, the elastic core yarn is selected from the group consisting of an elastomeric yarn, for example spandex, or neoprene or rubber.

According to yet another preferred embodiment of the invention, the first wrapper yarn comprises composite yarn which includes an ultrahigh molecular weight polyethylene fiber having high tensile strength.

According to yet another preferred embodiment of the invention, the second wrapper yarn comprises composite yarn which includes an ultrahigh molecular weight polyethylene fiber having high tensile strength.

According to yet another preferred embodiment of the invention, the first wrapper yarn and the second wrapper yarn each comprise a composite yarn which includes an ultrahigh molecular weight polyethylene fiber having high tensile strength.

Preferably, the first wrapper yarn comprises composite yarn a which includes as a first component a particle-filled fiber comprising a semi-crystalline polymer containing hard particles having a Mohs Hardness Value greater than 3.

According to yet another preferred embodiment of the invention, the second wrapper yarn comprises a composite yarn which includes as a first component a particle-filled fiber comprising a semi-crystalline polymer containing hard particles having a Mohs Hardness Value greater then 3.

According to yet another preferred embodiment of the invention, the first wrapper yarn and the second wrapper yarn each comprise a composite yarn which includes as a first component a particle-filed fiber comprising a semi-crystalline polymer containing hard particles having a Mohs Hardness Value greater than 3.

According to yet another preferred embodiment of the invention, wherein the core yarn comprises a 140 denier elastomeric yarn.

According to yet another preferred embodiment of the invention, the first wrapper yarn and the second wrapper yarn are at least 250 denier but not greater than 500 denier.

According to yet another preferred embodiment of the invention, a third wrapper yarn resides in parallel relation to the first wrapper yarn around the core yarn.

According to yet another preferred embodiment of the invention, a fourth wrapper yarn resides in parallel relation to the second wrapper yarn around the core yarn and the first and third wrapper yarns.

According to yet another preferred embodiment of the invention, the stretch yarn includes a second elastic core yarn residing in parallel relation to the first core yarn.

A further embodiment of a cut-resistant stretch yarn, comprises at least one elastic core yarn and a plurality of wrapper yarns spirally-wrapped around the at least one elastic core yarn in alternating twist directions, at least some of the plurality of wrapper yarns comprising a highly cut-resistant yarn.

According to yet another preferred embodiment of the invention, a cut-resistant stretch fabric is formed of yarn according to various embodiments of the invention.

Preferably, the fabric comprises knitted fabric.

According to one preferred embodiment of the invention, the fabric is in the form of a glove.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
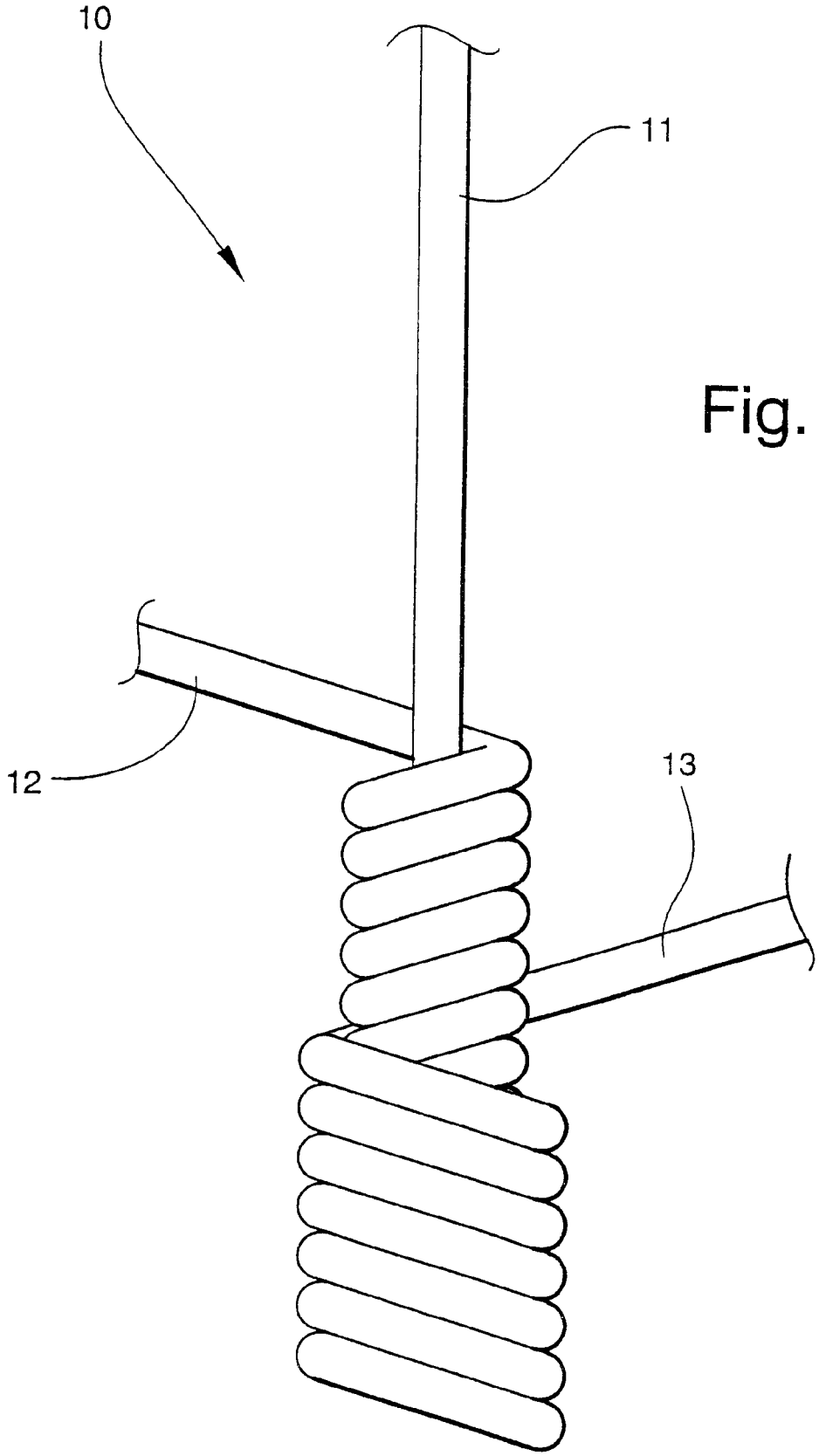
FIG. 1 is an enlarged schematic view of a yarn according to one embodiment of the invention.

Referring now specifically to the drawings, a cut-resistant yarn according to the present invention is illustrated in FIG. 1 and shown generally at reference numeral 10. Yarn 10 is comprised of a core yarn 11, a first wrapper yarn 12 and a second wrapper yarn 13. Preferably, the core yarn is formed of a highly elastic strand such as spandex, neoprene or rubber. Spandex is a well-known elastomeric fiber in which the fiber-forming substance is a long chain synthetic polymer comprised of at least 85% of a segmented polyurethane, and is sold under various trademarks, such as LYCRA, owned by DuPont. Neoprene is a synthetic rubber made by the polymerization of 2-chloro-1,3-butadiene, a substance produced by the action of hydrogen chloride on monovinylacetylene.

The wrapper yarns 12 and 13 are formed of highly cut-resistant yarns, such as yarns disclosed and claimed in U.S. Pat. Nos. 5,597,649 (Sandor et al) and 5,119,512 (Dunbar et al).

Dunbar discloses a composite yarn which includes an ultrahigh molecular weight polyethylene fiber having high tensile strength, such as sold under the trademark "Spectra" by Allied-Signal Inc.

Sandor discloses a composite yarn which includes as one component a particle-filled fiber comprising a semi-crystalline polymer such as polyethylene containing hard particles having a Mohs Hardness Value greater than 3 selected from the group consisting of tungsten metal particles and calcined aluminum oxide particles, where the average particle size is in the range of about 0.25 to about 6 microns, the particles comprising less than 10% by volume of the yarn. The particle filler provides significant cut-resistance, while the polyethylene provides flexibility, light weight, ease of use and all of the other characteristics for which it is known.

This yarn is sold under the trademark CRF by Allied.

A yarn construction according to FIG. 1 is shown below in Example 1.

EXAMPLE 1

| | |
|---|---|
| Core yarn 11 | 140 den. spandex |
| Wrapper yarn 12 | 435 CRF, Z-twist, 8 tpi |
| Wrapper 13 | 375 Spectra, S-twist, 8 tpi |

Figure 3:
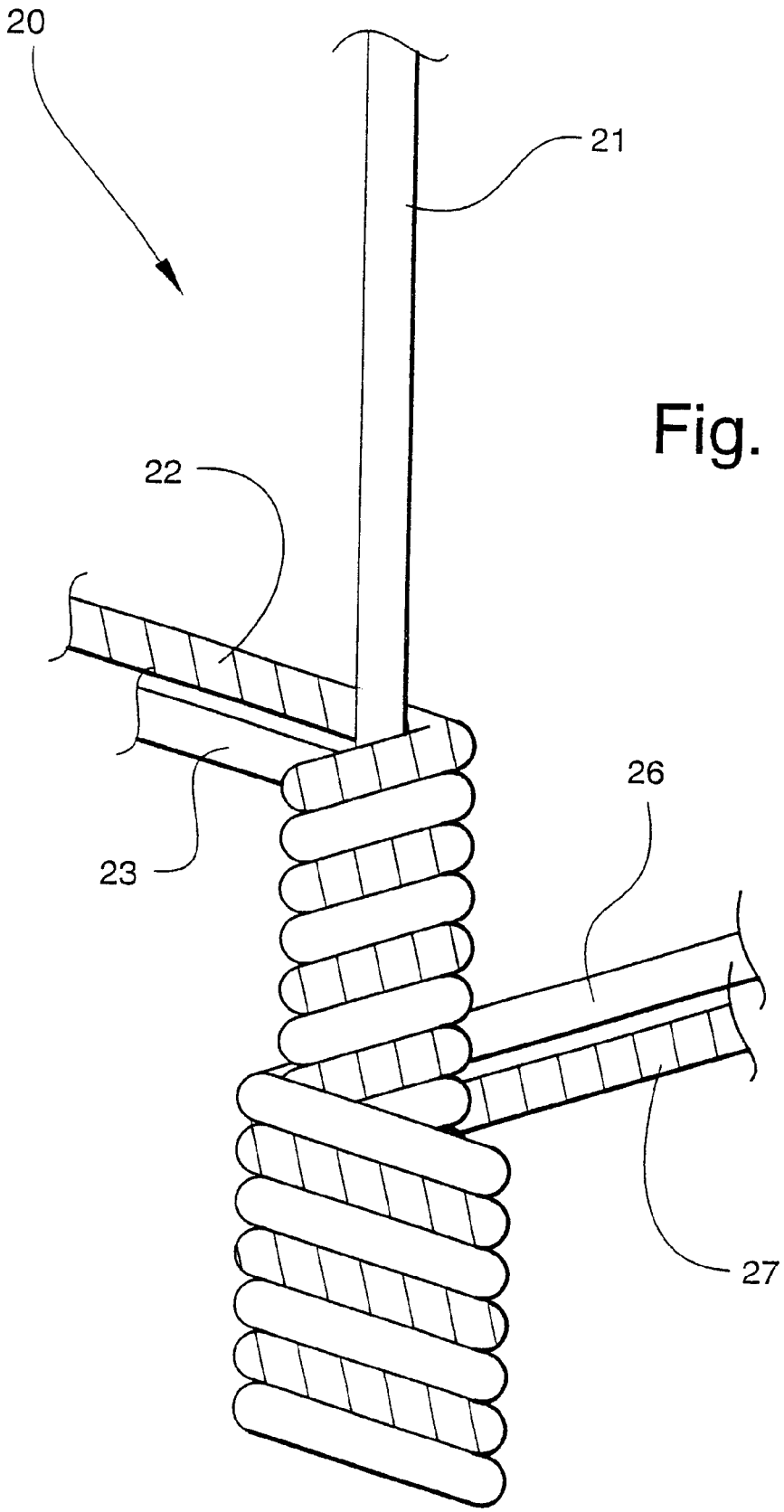
FIG. 3 is an enlarged schematic view of a yarn according to another embodiment of the invention.

Referring now to FIG. 3, an alternative cut-resistant stretch yarn configuration is shown broadly at reference numeral 20. Yarn 20 is comprised of a core yarn 21, a first and second wrapper yarns 22 and 23 and a third and fourth wrapper yarns 26 and 27. The lining shown on yarns 22 and 27 are intended to permit easy differentiation from yarns 23 and 26, and do not represent twist or any other yarn characteristic. Preferably, the core yarn 21 is formed of a highly elastic strand such as spandex, neoprene or rubber, as described above.

The wrapper yarns 22, 23, 26 and 17 are formed of highly cut-resistant yarns, such as yarns disclosed and claimed in U.S. Pat. Nos. 5,597,649 (Sandor et al) and 5,119,512 (Dunbar et al). The wrapper yarns 22 and 23 are wound onto the same spool in parallel relation and thus wrapped onto the core yarn 21 in parallel relation in a first twist direction, as shown.

A yarn construction according to FIG. 3 is shown below in Example 2.

EXAMPLE 2

| | |
|---|---|
| Core yarn 21 | 140 den. spandex |
| Wrapper yarn 22 | 435 CRF, Z-twist, 8 tpi |
| Wrapper yarn 23 | 375 Spectra, S-twist, 8 tpi |
| Wrapper yarn 26 | 435 CRF, Z-twist, 8 tpi |
| Wrapper yarn 27 | 375 Spectra, S-twist, 8 tpi |

As described above, Example 2 illustrates that a CRF yarn 22 and a Spectra yarn 23 can be wound on the same spool wrapped in a parallel orientation and applied to the core yarn 21. In Example 2, two such combinations of parallel yarns (22, 23 and 26, 27) are wrapped with alternate twist onto the single core yarn 21.

Both constructions provide two significant barriers against cutting penetration before the elastomeric core is reached. It is believed that providing the greatest cut-resistance the furthest distance away from the body part being protected will generally provide the greatest protection against injury.

Figure 4:
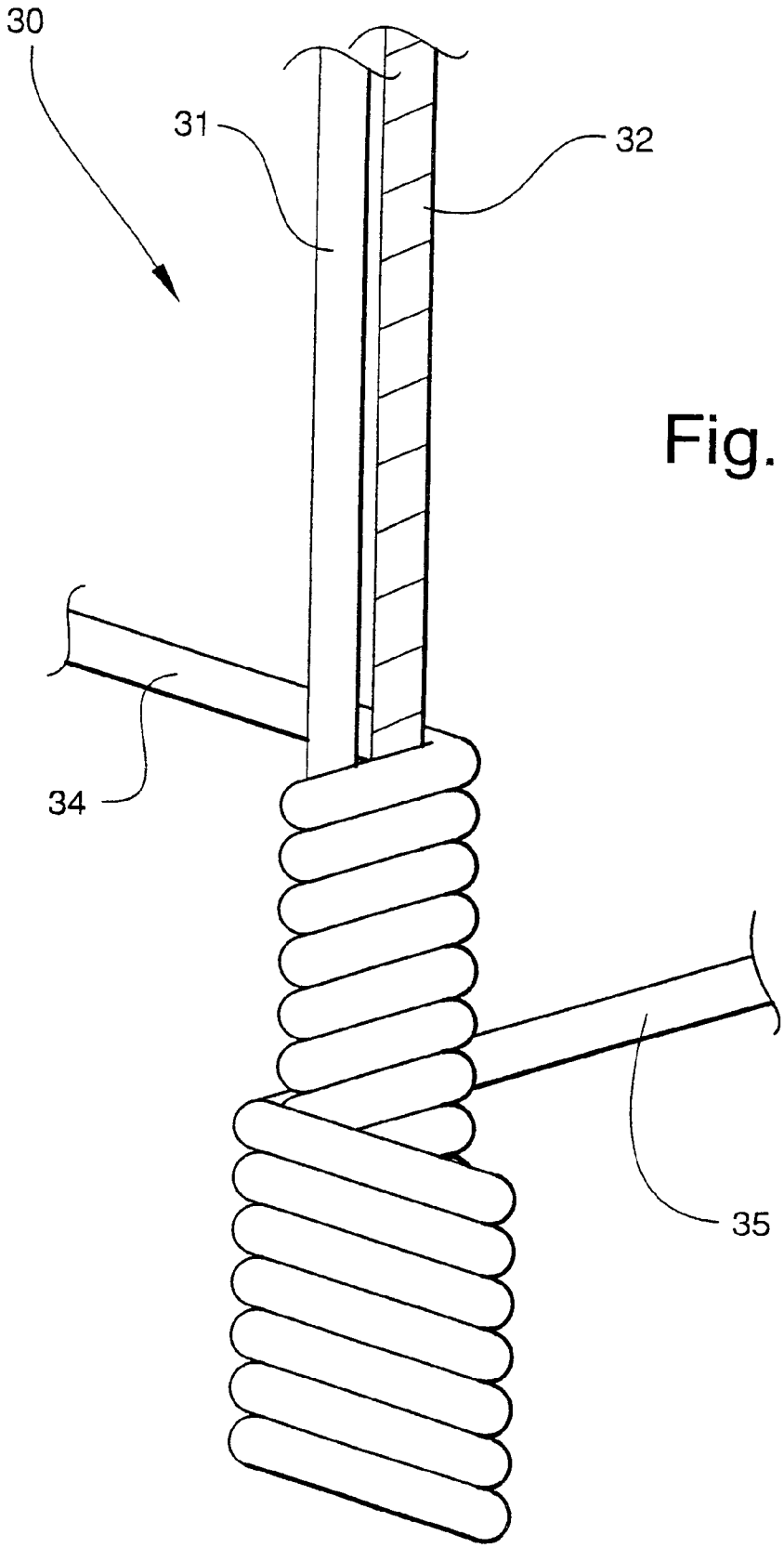
FIG. 4 is an enlarged schematic view of a yarn according to yet another embodiment of the invention.

Other constructions are possible. For example, FIG. 4 illustrates a yarn 30 with two stretch core yarns 31 and 32, wrapped with two wrapper yarns 34 and 35, as set out in Example 3:

EXAMPLE 3

| | |
|---|---|
| Core yarn 31 | 140 den. spandex |
| Core yarn 32 | 140 den. spandex |
| Wrapper yarn 34 | 435 CRF, Z-twist, 8 tpi |
| Wrapper 35 | 375 Spectra, S-twist, 8 tpi |

The lining shown on core yarn 32 is intended to permit easy differentiation from core yarn 31, and does not represent twist or any other yarn characteristic.

Figure 5:
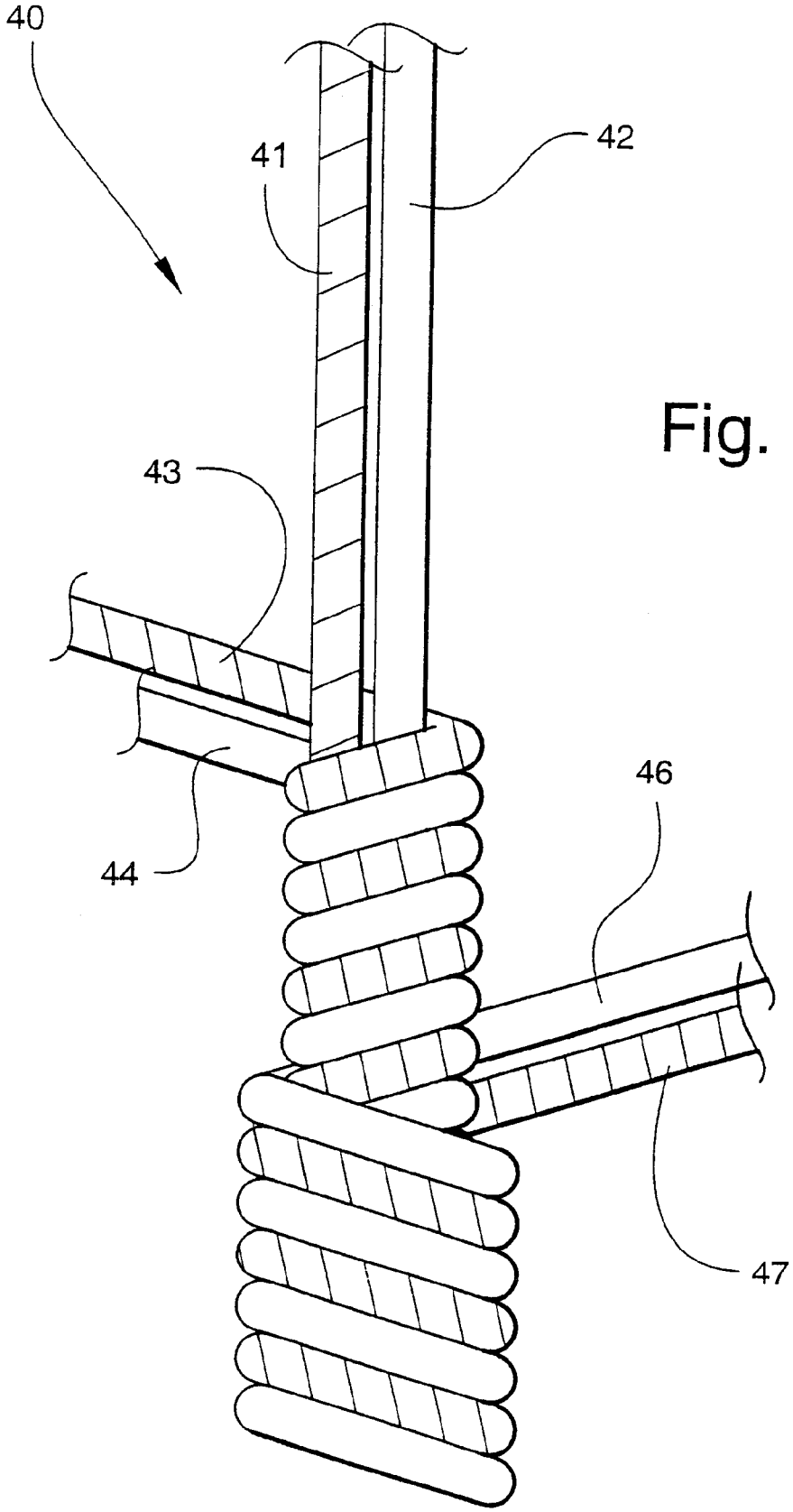
FIG. 5 is an enlarged schematic view of a yarn according to yet another embodiment of the invention.

A further embodiment is illustrated in FIG. 5, where a cut-resistant stretch yarn 40 is formed of a pair of parallel core yarns 41 and 42, parallel yarns (43, 44 and 46, 47) are wrapped with alternate twist around the core yarns 41 and 42. The core yarns 41 and 42 may each be stretch yarns as described in Example 1.

EXAMPLE 4

| | |
|---|---|
| Core yarn 41 | 140 den. spandex |
| Core yarn 42 | 140 den. spandex |
| Wrapper yarn 43 | 435 CRF, Z-twist, 8 tpi |
| Wrapper yarn 44 | 375 Spectra, S-twist, 8 tpi |
| Wrapper yarn 46 | 435 CRF, Z-twist, 8 tpi |
| Wrapper yarn 47 | 375 Spectra, S-twist, 8 tpi |

The lining shown on yarns 41, 43 and 47 are intended to permit easy differentiation from yarns 42, 44 and 46, respectively, and do not represent twist or any other yarn characteristic.

In yet another preferred embodiment (not shown), a third wrapper yarn is wrapped onto a construction as in Example 1. The third wrapper yarn may comprise a 250 denier high tenacity polyester, Z-twist yarn wrapped onto the yarn with 4 tpi.

In various constructions the wrapper yarns may be applied with as little as 1 tpi to as many as 150 tpi.

Figure 2:
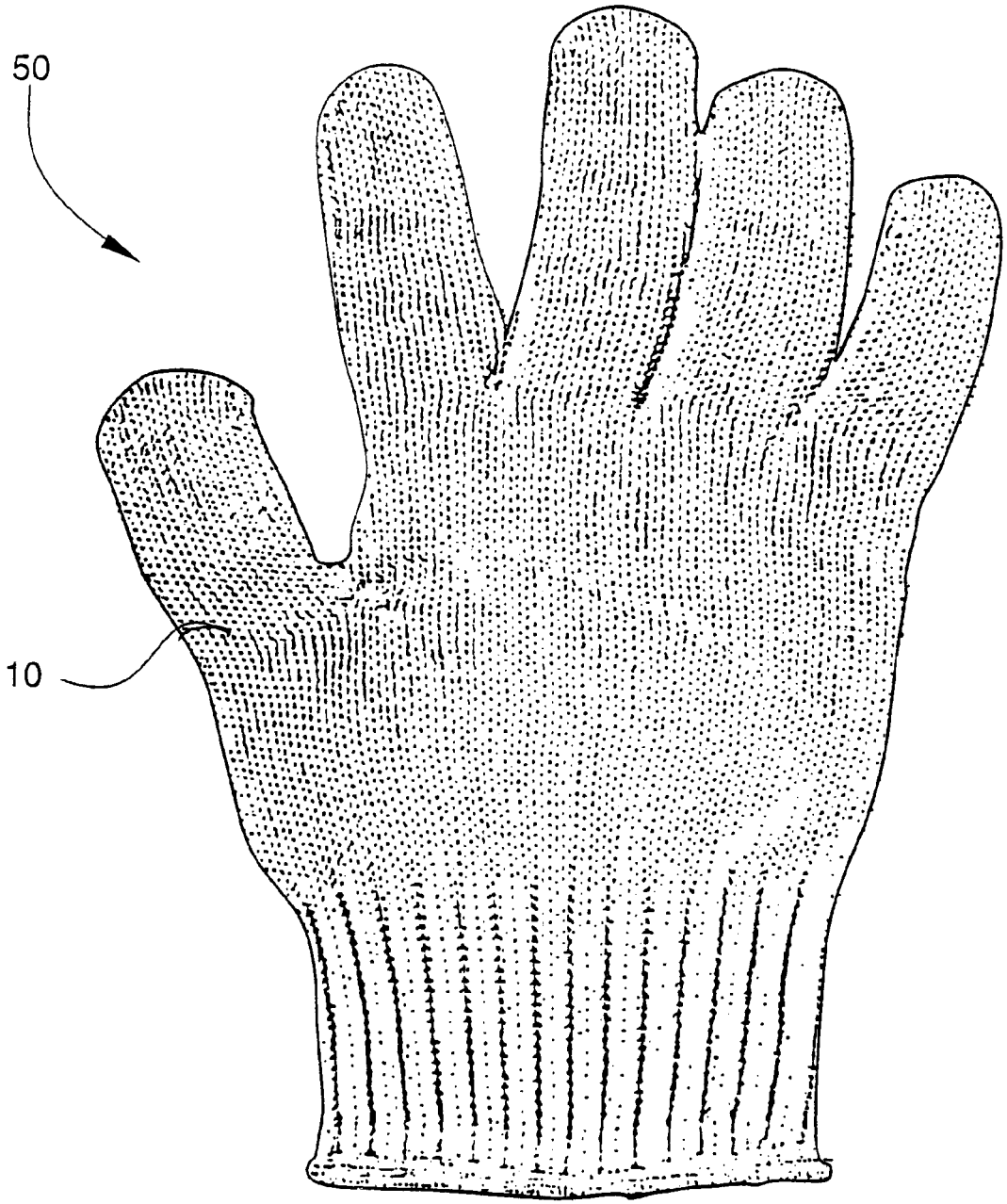
FIG. 2 is a view of a glove made from yarns constructed according to an embodiment of the invention.

A glove 50 knitted from the yarn 10 is illustrated in FIG. 2. The glove 50 may be knitted in all areas from the same yarns, or may have areas of reenforcement formed by double or triple fabric layers, or by laying in or plating in cut-resistant yarns according to this application or other cut resistant yarns.

A cut-resistant yarn and garment made from the yarn is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A cut-resistant stretch yarn, comprising:

(a) a first elastic core yarn, (b) a first wrapper yarn spirally-wrapped around the elastic core yarn in a first twist direction, said first wrapper yarn comprising a highly cut-resistant yarn;

(c) a second wrapper yarn spirally-wrapped around the elastic core yarn and the first wrapper yarn in a second twist direction, said second wrapper yarn comprising a highly cut-resistant yarn; and (d) wherein one of said first and second wrapper yarns comprises a composite yarn which includes an ultrahigh molecular weight polyethylene fiber having high tensile strength, and one of said first and second wrapper yarns comprises a composite yarn which includes a particle-filled fiber comprising a semi-crystalline polymer containing hard particles having a Mohs Hardness Value greater than 3.

2. A cut-resistant stretch yarn according to claim 1, wherein said elastic core yarn is selected from the group consisting of an elastomeric yarn, neoprene or rubber.

3. A cut-resistant stretch yarn according to claim 2, wherein said first wrapper yarn comprises composite yarn which includes an ultrahigh molecular weight polyethylene fiber having high tensile strength.

4. A cut-resistant stretch yarn according to claim 3, wherein said second wrapper yarn comprises a composite yarn which includes as a first component a particle-filled fiber comprising a semi-crystalline polymer containing hard particles having a Mohs Hardness Value greater than 3.

5. A cut-resistant stretch yarn according to claim 2, wherein said second wrapper yarn comprises composite yarn which includes an ultrahigh molecular weight polyethylene fiber having high tensile strength.

6. A cut-resistant stretch yarn according to claim 2, wherein said first wrapper yarn and said second wrapper yarn each comprise a composite yarn which includes an ultrahigh molecular weight polyethylene fiber having high tensile strength.

7. A cut-resistant stretch yarn according to claim 2, wherein said first wrapper yarn comprises a composite yarn which includes as a first component a particle-filled fiber comprising a semi-crystalline polymer containing hard particles having a Mohs Hardness Value greater than 3.

8. A cut-resistant stretch yarn according to claim 7, wherein said second wrapper yarn comprises a composite yarn which includes an ultrahigh molecular weight polyethylene fiber having high tensile strength.

9. A cut-resistant stretch yarn according to claim 2, wherein said second wrapper yarn comprises a composite yarn which includes as a first component a particle-filled fiber comprising a semi-crystalline polymer containing hard particles having a Mohs Hardness Value greater than 3.

10. A cut-resistant stretch yarn according to claim 2, wherein said first wrapper yarn and said second wrapper yarn each comprise a composite yarn which includes as a first component a particle-filled fiber comprising a semi-crystalline polymer containing hard particles having a Mohs Hardness Value greater than 3.

11. A cut-resistant stretch yarn according to claim 2, wherein said core yarn comprises a 140 denier elastomeric yarn.

12. A cut-resistant stretch yarn according to claim 2, wherein said first wrapper yarn and said second wrapper yarn are at least 250 denier but not greater than 500 denier.

13. A cut-resistant stretch yarn according to claim 2, and including a third wrapper yarn residing in parallel relation to said first wrapper yarn around the core yarn.

14. A cut-resistant stretch yarn according to claim 13, and including a fourth wrapper yarn residing in parallel relation to said second wrapper yarn around the core yarn and the first and third wrapper yarns.

15. A cut-resistant stretch yarn according to claim 2, wherein said stretch yarn includes a second elastic core yarn residing in parallel relation to the first core yarn.

16. A cut-resistant stretch yarn according to claim 1, wherein said first wrapper yarn comprises a composite yarn which includes an ultrahigh molecular weight polyethylene fiber having high tensile strength and said second wrapper yarn comprises a composite yarn which includes as a first component a particle-filled fiber comprising a semi-crystalline polymer containing hard particles having a Mohs Hardness Value greater than 3.

17. A cut-resistant stretch yarn according to claim 1, wherein said first wrapper yarn comprises a composite yarn which includes as a first component a particle-filled fiber comprising a semi-crystalline polymer containing hard particles having a Mohs Hardness Value greater than 3 and said second wrapper yarn comprises a composite yarn which includes an ultrahigh molecular weight polyethylene fiber having high tensile strength.

18. A cut-resistant stretch yarn, comprising:

(a) at least one elastic core yarn;

(b) a plurality of wrapper yarns spirally-wrapped around the at least one elastic core yarn in alternating twist directions, at least one of said plurality of wrapper yarns comprising a highly cut-resistant yarn selected from the group consisting of a composite yarn which includes an ultrahigh molecular weight polyethylene fiber having high tensile strength, and at least one of said plurality of wrapper yarns comprising a composite yarn which includes a particle-filled fiber comprising a semi-crystalline polymer containing hard particles having a Mohs Hardness Value greater than 3.

19. A cut-resistant stretch fabric formed of yarn according to claim 1, 2, 3, 5, 6, 7, 8, 10, 11, 12, 13, 14, 15, or 18.

20. A cut-resistant stretch fabric according to claim 19, wherein said fabric comprises knitted fabric.

21. A cut resistant stretch fabric according to claim 20, wherein said fabric is in the form of a glove.

22. A cut resistant stretch fabric according to claim 20, wherein the first and second wrapper yarns are each comprised yarns having a denier of between 100 and 4,800 denier.

23. A cut-resistant stretch yarn, comprising:

(a) a first elastic core yarn selected from the group consisting of an elastomeric yarn, neoprene and rubber;

(b) a first wrapper yarn spirally-wrapped around the elastic core yarn in a first twist direction, said first wrapper yarn comprising a highly cut-resistant yarn having a denier of between 20 and 1000 denier;

(c) a second wrapper yarn spirally-wrapped around the elastic core yarn and the first wrapper yarn in a second twist direction, said second wrapper yarn comprising a highly cut-resistant yarn having a denier of between 20 and 1000 denier; and (d) wherein at least one of said first and second wrapper yarns comprises a composite yarn which includes an ultrahigh molecular weight polyethylene fiber having high tensile strength, and at least one of said first and second wrapper yarns comprises a composite yarn which includes a particle-filled fiber comprising a semi-crystalline polymer containing hard particles having a Mohs Hardness Value greater than 3.

* * * * *